US006132155A

United States Patent [19]

Gouliard et al.

[11] Patent Number: 6,132,155

[45] Date of Patent: Oct. 17, 2000

[54] PROCESS FOR CAN BOTTOM MANUFACTURE FOR IMPROVED STRENGTH AND MATERIAL USE REDUCTION

[75] Inventors: J. L. Gouliard, Ballwin, Mo.; J. J. Kester, Westerville, Ohio; C. J. Szwargulski, Ellisville, Mo.

[73] Assignee: Metal Container Corporation, S. Louis, Mo.

[21] Appl. No.: 09/037,477

[22] Filed: Mar. 10, 1998

Related U.S. Application Data

[62] Division of application No. 08/546,992, Oct. 23, 1995, abandoned.

[51] Int. Cl.[7] ..... B21D 51/26

[52] U.S. Cl. ..... 413/69; 413/1; 413/76

[58] Field of Search ..... 413/69, 76, 1; 220/606, 604, 608, 609, 623, 624, 906; 72/117, 123

[56] References Cited

U.S. PATENT DOCUMENTS

| | | | |
|---|---|---|---|
| 4,065,951 | 1/1978 | Lyu | 413/69 X |
| 4,412,627 | 11/1983 | Houghton et al. | 220/66 |
| 4,722,215 | 2/1988 | Taube et al. | 413/76 X |
| 4,834,256 | 5/1989 | McMillin | 220/66 |
| 4,863,333 | 9/1989 | Kaminski | 413/69 |
| 4,885,924 | 12/1989 | Claydon et al. | 72/102 |
| 4,919,294 | 4/1990 | Kawamoto et al. | 220/70 |
| 4,953,738 | 9/1990 | Stirbis | 220/606 |
| 5,024,077 | 6/1991 | Bulso, Jr. et al. | 413/76 X |
| 5,105,973 | 4/1992 | Jentzsch et al. | 220/606 |
| 5,325,696 | 7/1994 | Jentesch et al. | 413/69 X |
| 5,341,677 | 8/1994 | Lee, Jr. | 413/69 X |
| 5,351,852 | 10/1994 | Trageser et al. | 220/606 |
| 5,540,352 | 7/1996 | Halasz et al. | 220/606 |

OTHER PUBLICATIONS

Hosford, W.F. and Duncan, J.L., "The Aluminum Beverage Can", *Scientific American,* pp. 48–53, Sep. 1994.

*Primary Examiner*—James F. Coan
*Attorney, Agent, or Firm*—Carr &Storm, L.L.P.

[57] ABSTRACT

A new end wall or can bottom configuration for beverage cans and a method for its manufacture have been designed which provide an increased resistance to pressure and which allow an additional light-weighting of the can bottom.

9 Claims, 7 Drawing Sheets

EXISTING PROCESS $R_1 > R_2$

ACTUAL PROFILE – EXISTING PROCESS

PROCESS FOR CAN BOTTOM MANUFACTURE FOR IMPROVED STRENGTH AND MATERIAL USE REDUCTION

CROSS REFERENCE TO RELATED APPLICATIONS

This is a division of U.S. patent application Ser. No. 08/546,992 filed Oct. 23, 1995, and now abandoned, the content of which application is hereby incorporated herein by reference.

TECHNICAL FIELD OF THE INVENTION

The present invention relates to an improved process for the manufacture of drawn and ironed can bodies with an end wall or bottom profile providing increased resistance to pressure and, consequently, allowing the additional light-weighting of the can bottom. The present invention also relates to can bodies incorporating the new bottom profile.

BACKGROUND OF THE INVENTION

In general, this invention relates to drawn and ironed cans, and, in particular, to drawn and ironed can bodies having an improved end wall configuration.

The so-called drawn and ironed can has, to a large extent, replaced the old three-piece can in the beverage industry. These cans are made almost exclusively from aluminum, which, being quite ductile, is easily drawn into a cylindrical configuration and ironed down to a very thin wall thickness. While the economies of mass production are reflected in the low cost of the cans, the cost of the sheet aluminum stock from which the cans are manufactured has nevertheless always been an important consideration. Through the years various advances in can technology have enabled the can bodies to be manufactured from increasingly thinner aluminum sheet stock. This effort to manufacture drawn and ironed cans from increasingly thinner aluminum sheet stock is known as "light-weighting."

The typical drawn and ironed can consists of two components, namely a lid and a can body, only the latter of which is formed by the drawing and ironing process. When completed, the can body includes a very thin side wall and a domed end wall integrally formed with the side wall at one end. The opposite end of the side wall is joined to the lid along a seam after a beverage is introduced into the can body.

To form the can bodies, circular disks are first stamped or blanked from aluminum sheet stock of the appropriate thickness. Next, each disk is drawn into a cup. The cup is then placed over the end of a punch and forced through a series of dies where it is redrawn into a lesser diameter and ironed along its side wall to substantially reduce the thickness of the side wall while at the same time elongating it. The end wall, on the other hand, generally retains the original thickness of the sheet stock throughout the entire process. After the side wall is completely ironed, a domed configuration and surrounding rim is imparted to the flat end wall. This configuration enables the end wall to withstand predetermined internal pressures without buckling outward and rendering the can unstable. The pressure at which a given dome profile and thickness buckles outward is known as the dome reversal pressure or DRP. The domed configuration and surrounding rim also give the can adequate column strength.

The ability of a can to withstand internal pressure loads developed by the carbonated liquid therein during pasteurization, consumer storage, and consumer transportation is a result of, among other things, the bottom profile geometry and metal gauge of the can. The final can bottom profile is the result of two processes. The first process, which is performed after the last ironing operation, gives the can bottom its inward or convex bulge. Prior to the present invention, a punch assembly consisting of a punch sleeve and a punch nose was used to drive the flat base of the can against a metal dome plug having a configuration corresponding to that of the punch nose except that the diameter of the dome plug was less than the diameter of the domed region of the punch nose by a distance equal to twice the thickness of the metal of the can bottom plus 0.010" clearance. In other words, in the prior process, the clearance between the dome plug and the punch nose was minimized. Thus, in the prior process the diameter of the dome plug is identical to the diameter of the desired dome of the can end. The finished can after this stage of processing is called a "preform." Preform geometry is determined by the tooling installed in the body maker.

The second process is known as the base profile reforming or BPR process. In the BPR processes, the can bottom profile or geometry is reformed to increase its ability to withstand pressure loads, i.e., to increase its strength. To do this, the domed can bottom is driven against a BPR chuck having a diameter equal to that of the dome plug. However, unlike the dome plug, the BPR chuck has a horizontal upper surface, rather than a domed one. The finished can after the BPR process is termed a "reform." Reform geometry is controlled by the BPR process and its tooling geometry.

It has now been found that modifying the preform tooling by reducing the diameter of the dome plug so that the clearance between the dome plug and the punch nose is greater than the minimized clearance, and making the corresponding reduction in the diameter in the BPR chuck, the DRP of the finished can body can be increased or conversely, the can end can be light-weighted without a corresponding reduction in DRP. In particular, it has been found that reducing the diameter of the dome plug and making the corresponding reduction in the diameter of the BPR chuck by about 0.02" in relation to that which provides for a minimum clearance between the dome plug and the punch nose for a given can size, increases the dome reversal pressure by 2–3 psi. This allows an additional light-weighting of the can bottom by approximately 0.0002"–0.0003" beyond that which was capable with the existing process.

SUMMARY OF THE INVENTION

The present invention relates to a new end wall or can bottom configuration for beverage can bodies which provides an increased resistance to pressure loads, thereby allowing an additional light-weighting of the can body.

In another embodiment, the present invention relates to a process for manufacturing can bodies incorporating the improved end wall configuration.

BRIEF DESCRIPTION OF THE DRAWINGS

The invention may be more readily understood from the following drawings with the detailed description. The drawings are not restrictive of the invention, but rather, illustrative.

DETAILED DESCRIPTION

As used herein, "concave" and/or "convex" shall mean concave and/or convex with respect to the outside of the can body.

As used herein, the first digit of a numerical designation for a can size shall refer to inches and the remaining digits shall refer to sixteenths of an inch. For example, a can diameter of "204" refers to a can having a diameter of 2 and 4/16".

Typically, a can body is formed in a drawing and ironing process which may be one of the conventional drawing and ironing procedures used in the can industry today. A drawn and ironed can body has a cylindrical side wall and an integral end wall closing one end of the side wall. The end wall includes an annular rim that generally curves inwardly from the side wall and a domed central section which closes the area circumscribed by the rim, all such that the rim forms the lowest portion of the can body.

Figure 1:
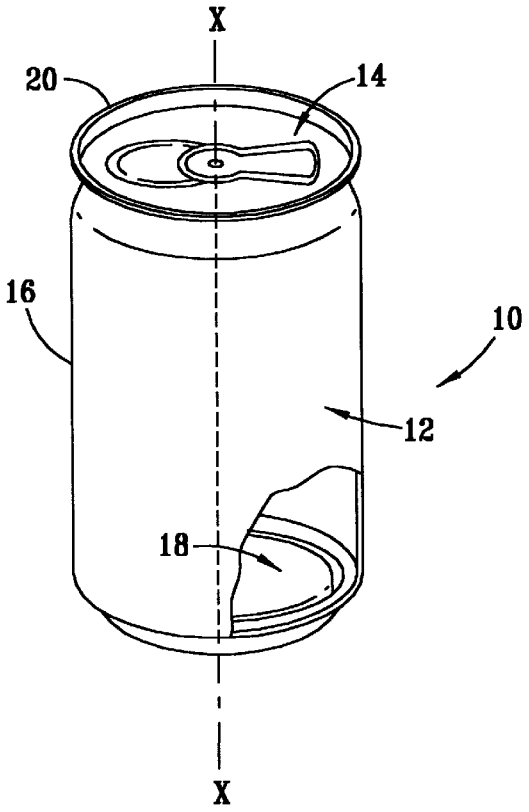
FIG. 1 is a perspective view of a beverage can having a drawn and ironed can body constructed in accordance with and embodying the present invention.

Referring now to the drawings and particularly to FIG. 1, there is shown a beverage can 10 consisting of two components, namely a can body 12 and a lid or top wall 14. The can body 12 has a very thin side wall 16 joined integrally to a somewhat thicker end wall 18 at one end of the side wall 16. The lid 14 is fastened to the other end of the side wall 16 of the can body 12 at a chime 20, and when so fastened, the body 12 and lid 14 enclose a fluid-tight cylindrical space in which a beverage or other liquid may be contained. The lid 14 is conventional and is joined to the can body 12 in a conventional seaming operation. The can 10 has a vertical axis X, which is the center axis of the cylindrical side wall 16.

Figure 2:
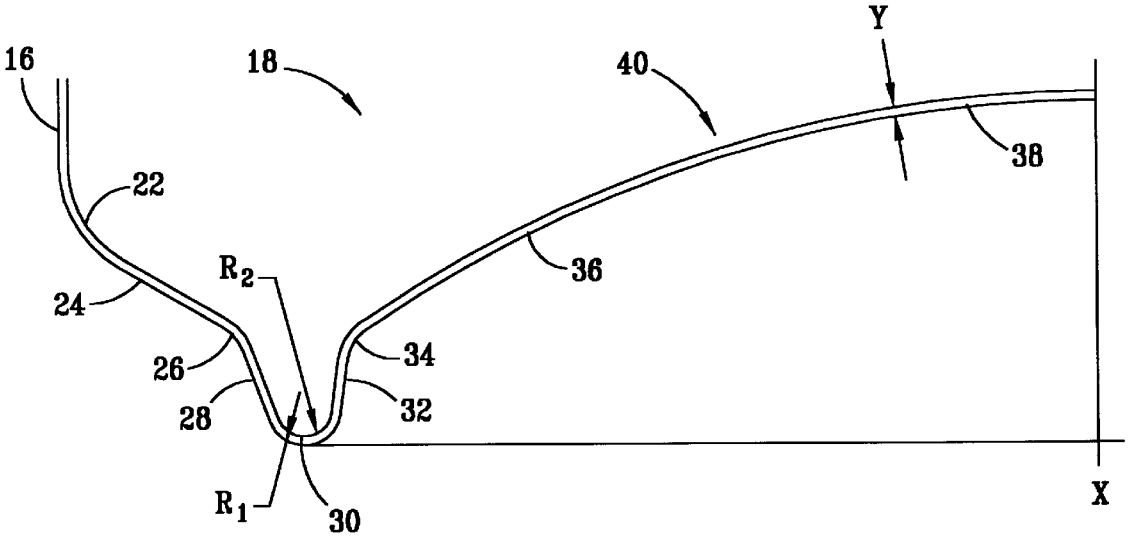
FIG. 2 (PRIOR ART)
FIG. 2 is a fragmentary, cross-sectional view of the end wall showing the reform geometry resulting from the prior processes and similar to that which results from the present invention.
Figure 9:
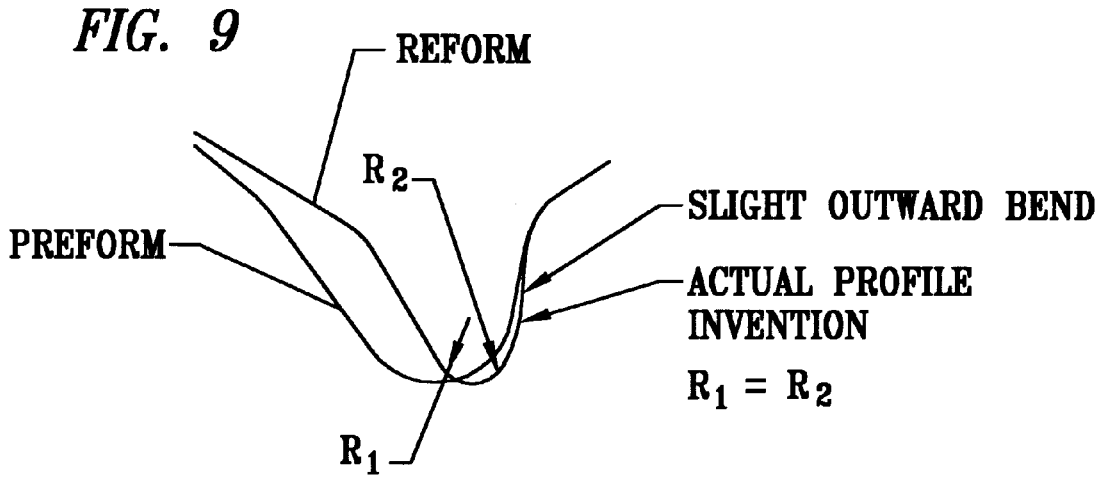
FIG. 9 is a cross-sectional view of the end wall rim preform and reform geometry resulting from the present invention.
Figure 11:
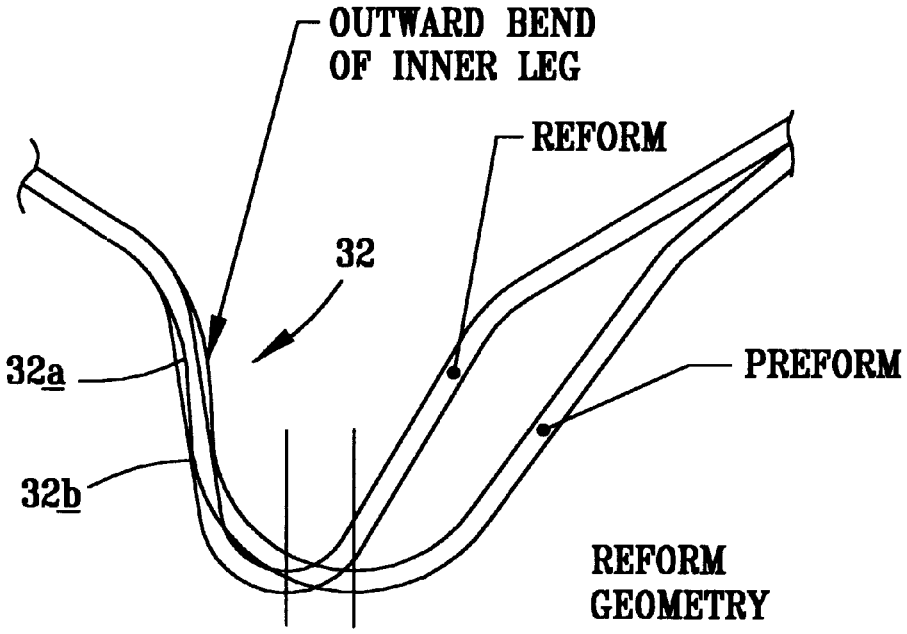
FIG. 11 is a cross-sectional view of the end wall rim showing the preform and reform geometry resulting from the present invention.

Referring now to FIG. 2 for more detail, it can be seen that end wall 18, beginning at the side wall 16 and going inwardly toward the can axis X includes convex arcuate segment 22, tapered intermediate portion 24, first concave arcuate segment 26, tapered outer leg 28, arcuate rim 30 comprising an outer radius $R_1$ and an inner radius $R_2$, inner leg 32, second concave arcuate segment 34 and domed central section 40, wherein each arcuate segment interconnects the regions located immediately adjacent it on either side. FIG. 2 is an illustration of the reform geometry resulting from the prior process. The reform geometry resulting from the present invention is the same but for the slight outward bend, also known as a back angle, in the upper portion 32*a* of inner leg 32 as illustrated in FIGS. 9 and 11.

Preferably, the end wall comprises a side wall joining region 21, an annular rim 31 joined to the side wall 16 by the side wall joining region 21, and a dome-shaped central section 40 encircled by and joined to the annular rim 31 with the concave surface 38 of the central section 40 being the exterior of the can.

The side wall joining portion 21 includes the convex arcuate segment 22 and the tapered intermediate portion 24. The convex arcuate segment 22 connects the side wall 16 to the tapered intermediate portion 24. The tapered intermediate portion 24 is, in turn, connected to the annular rim 31.

The annular rim 31 has a first concave arcuate segment 26, the tapered outer leg 28, the arcuate rim 30 comprising the outer radius of curvature $R_1$ and the inner radius of curvature $R_2$, slightly outwardly bent inner leg 32, and the second concave arcuate segment 34. The first concave arcuate segment 26 joins the tapered intermediate portion 24 to the tapered outer leg 28. The arcuate rim 30 joins the tapered outer leg 28 and the slightly outwardly bent inner leg 32 while the second concave arcuate segment 34 joins the dome-shaped central section 40 to the inner leg 32.

The domed-shaped central section 40 has an inner region 38 joined to outer region 36 which, in turn, is joined to the slightly outwardly bent inner leg 32 by the second concave arcuate segment 34.

The drawing and ironing process begins with a disk blanked or stamped from suitable sheet metal stock, usually aluminum or an aluminum alloy, which is then drawn into a cup. This operation does not substantially alter the thickness of the metal within the cup. As a result, the flat end wall and cylindrical side wall of the cup initially have the same thickness as the sheet metal stock. The cup is then placed on the end of a punch and by means of the punch is driven through a succession of dies. The first die is a redraw die which merely reduces the diameter of the cup side wall. It does not alter its thickness. The remaining dies are ironing dies which reduce the thickness of the cup side wall and simultaneously, further elongate it. Upon emerging from the last ironing die, the cup side wall is fully converted into the can body side wall 16 which is cylindrical in shape, having a specified radius and thickness, the latter being considerably less than the thickness of the flat end wall, i.e., the original sheet metal stock.

Figure 3:
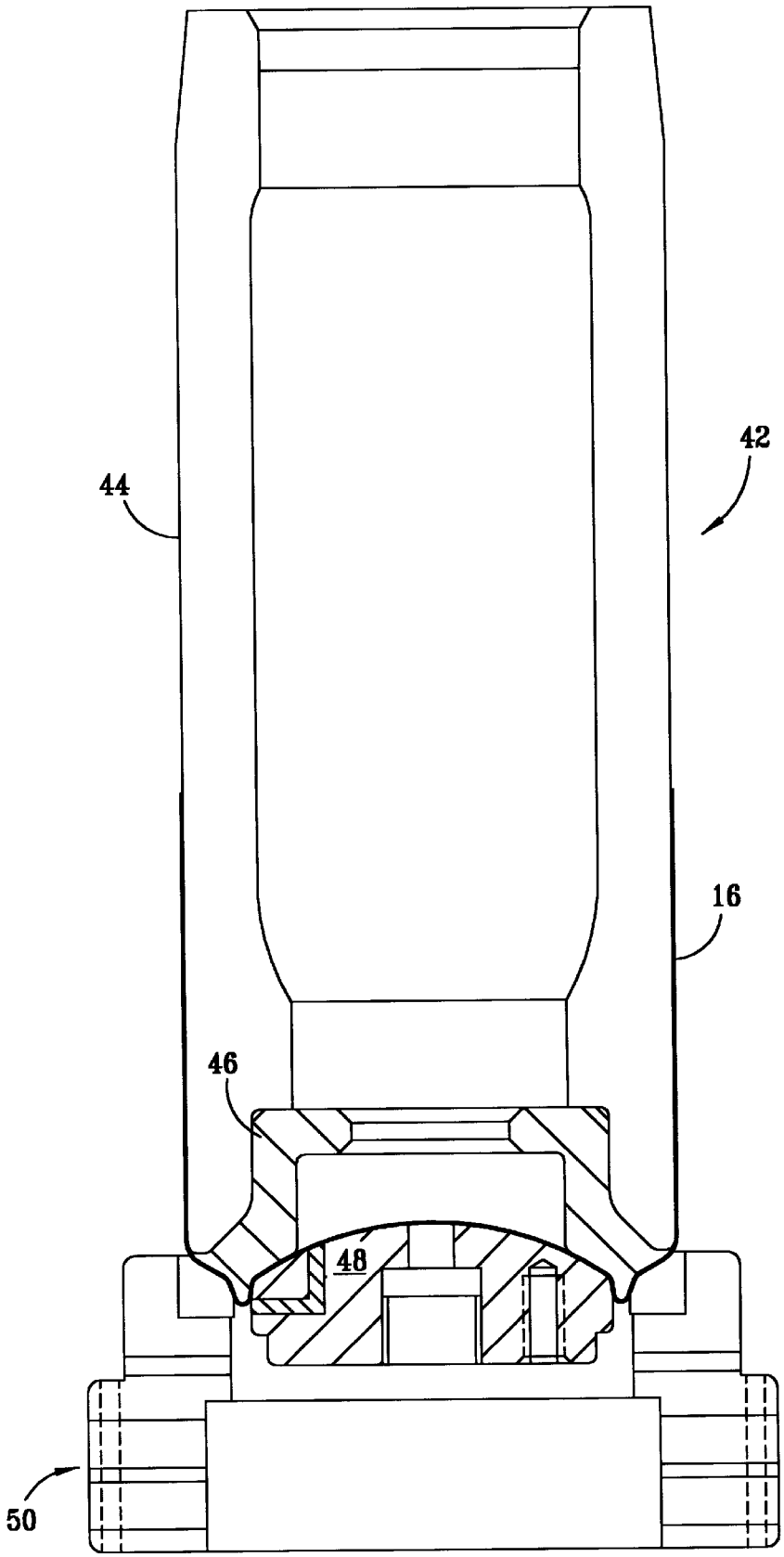
FIG. 3 is an illustration of the operational relationship of the outer retainer, dome plug, punch nose and punch sleeve used to obtain the preform configuration.

Referring now to FIG. 3, as the free end of the side wall 16 passes out of the last ironing die, the can is driven by a punch assembly 42 consisting of a punch sleeve 44 and a punch nose 46 against an outer retainer or forming die 50. A clamping pressure is exerted on the metal between the outer retainer 50 and the punch nose 46. The entire assembly is then driven against a forming die or dome plug 48 having a configuration identical to that portion of the final preform product circumscribed by the arcuate rim 30. This converts the flat end wall into the contoured end wall 18 having the desired domed profile or configuration. The forward end of the punch 42, i.e., the punch nose 46, and the forming die or dome plug 48 have complementary surfaces which cooperate to impart the desired configuration or profile to the end wall 18 without altering the thickness Y of the end wall 18.(FIG. 2) That thickness remains essentially the same as the thickness of the original sheet metal stock throughout the entire process. This process can be performed by a number of commercially available can body makers, including the Ragsdale CR 24, CR 20, and CR 18.5, Reynolds Mark III, Standun Model No. B2, B3, and B5, and CMB Engineering Model No. 5000 body makersoperated according to the manufacturers instructions.

Figure 4A:
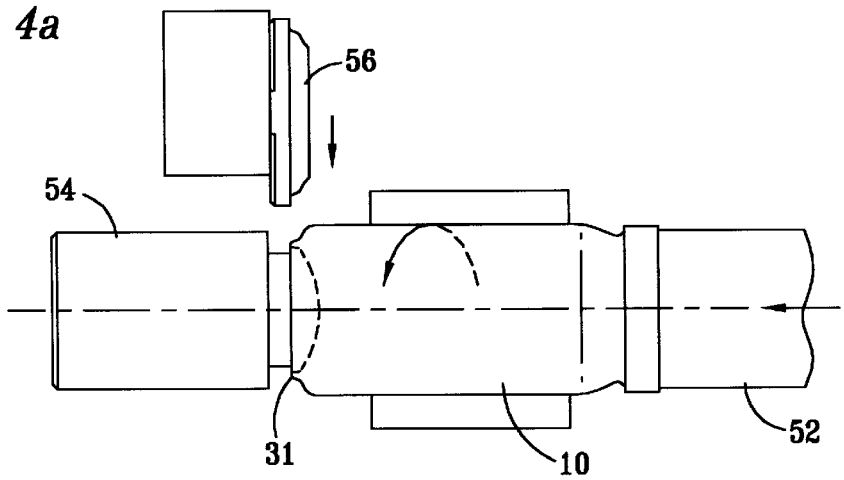
FIG. 4*a* and 4*b* depict the can, reforming roll, and BPR chuck and their operation in the base profile reforming process, respectively.
Figure 4B:
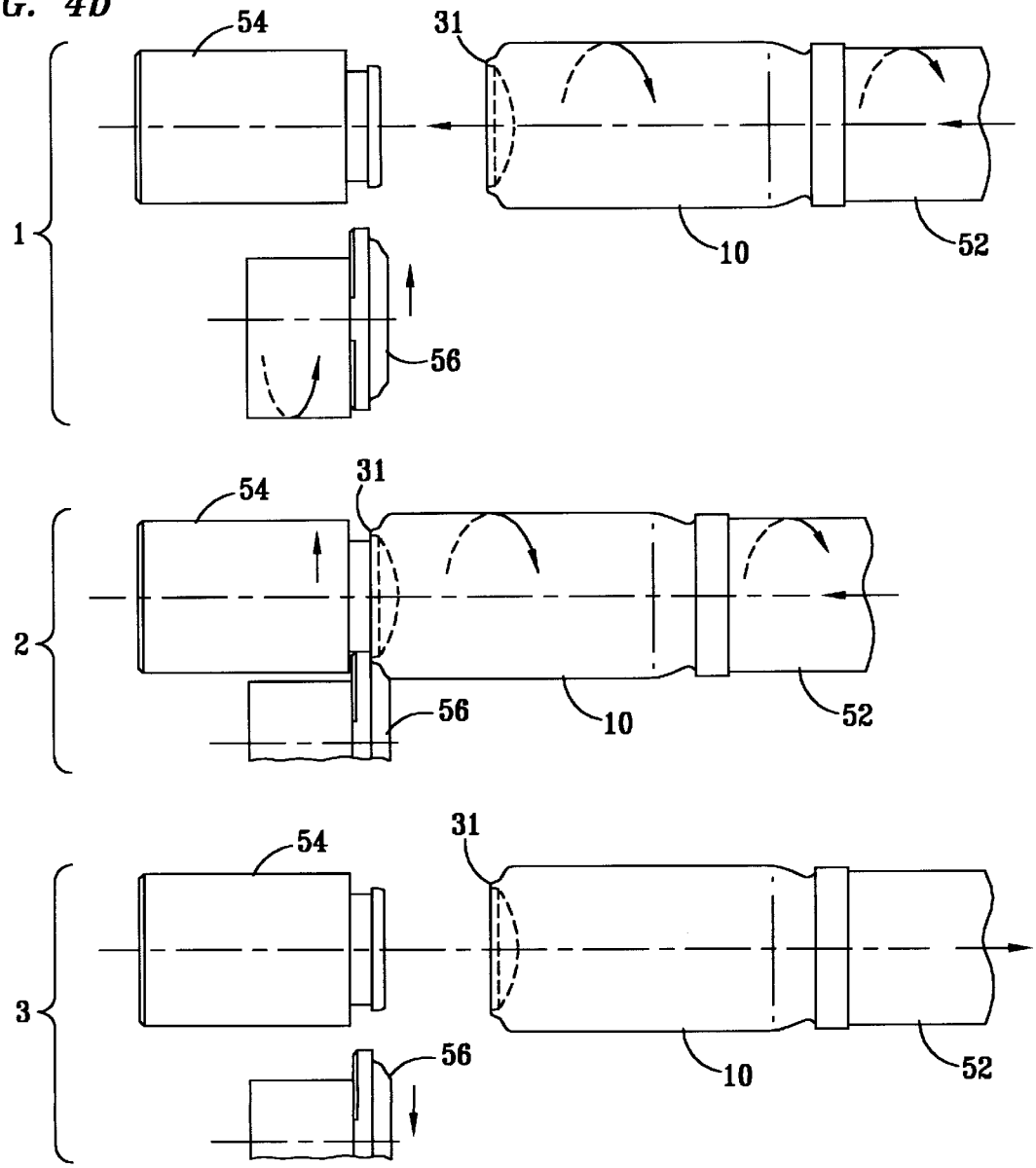

After leaving the body maker, the domed can body or preform is trimmed to the proper height, washed, decorated, coated, necked, and flanged. This semi-finished can body or preform is passed to the base profile reformer, wherein the can bottom profile is reshaped by the base profile reforming (BPR) process. This process can also be performed using commercially available equipment such as CMB Engineering's Model No. B210 Base Profile Reformer For Two-Piece Cans. The bottom profile is altered by driving portions of the domed can bottom 18 circumscribed by the arcuate rim 30 against a cylindrical BPR plug or chuck 54 which contacts the inner dome 40 at the second concave arcuate segment 34. Simultaneously, pressure is exerted against the exterior of the annular rim 31 by a roll disc or reforming roll 56 against the outer profile along first concave arcuate segment 26, tapered outer leg 28 and outer radius $R_1$ to reform the bottom profile (FIGS. 4*a* and 4*b*). Spinning the can 10 between the BPR chuck 54 and reforming roll 56 results in an end wall construction with an increased DRP.

Figure 8A:
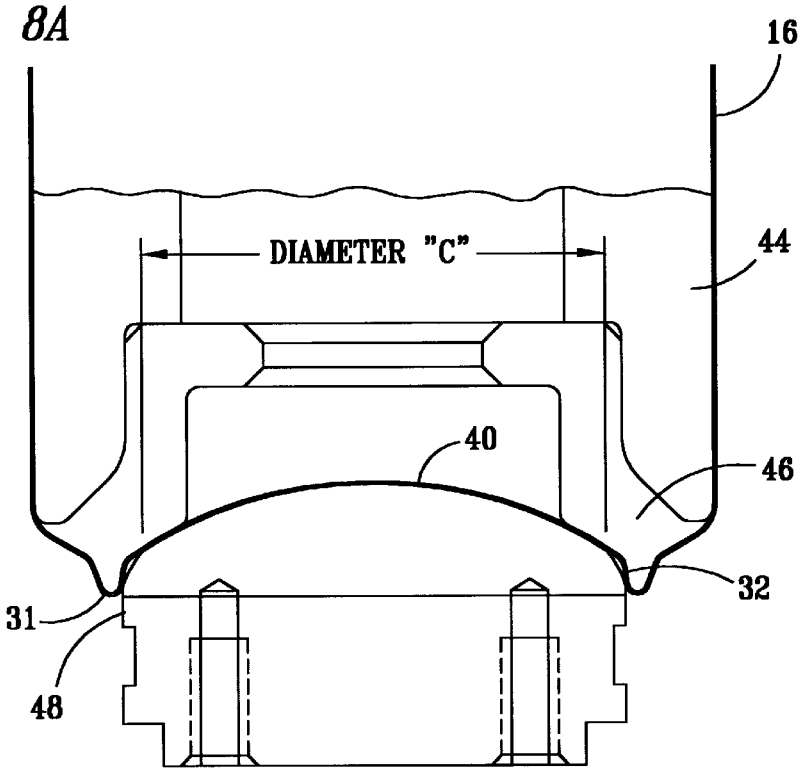
FIGS. 8*a* and 8*b* are cross-sectional views of the can body, punch assembly and the dome plug showing the configurations of the dome plug of the present invention and existing processes, respectively.
Figure 8B:
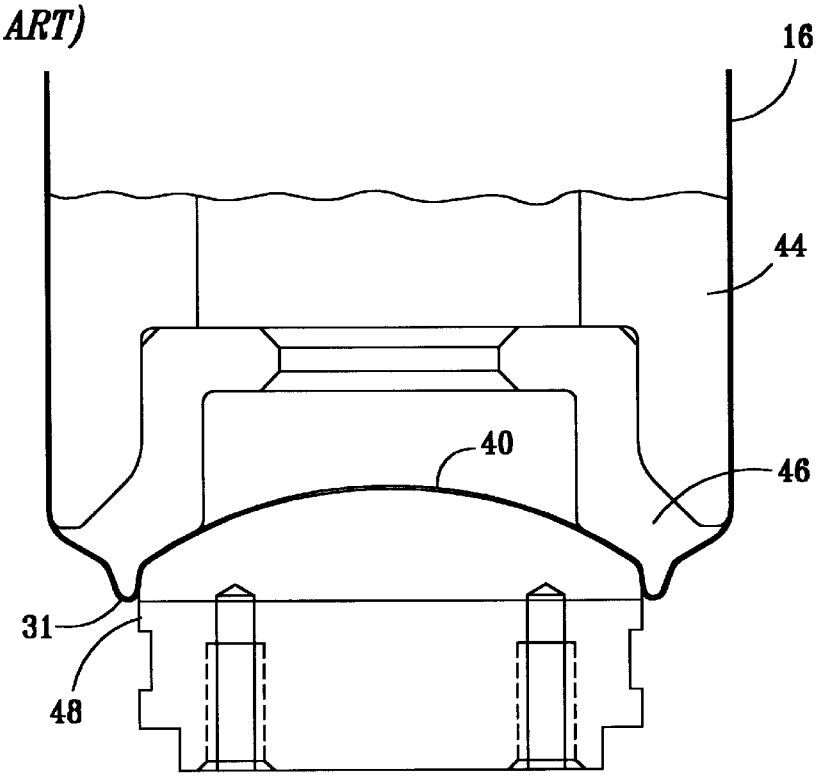
FIG. 8B (PRIOR ART)
Figure 10A:
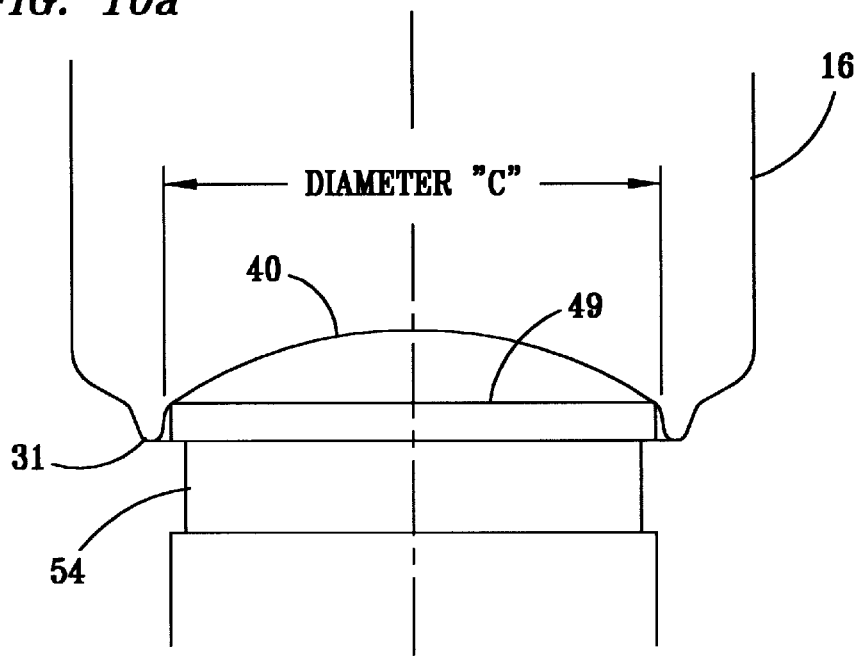
FIG. 10*a* and 10*b* are cross-sectional views of the can body and the BPR chuck showing the configuration of the BPR chuck of the present invention and existing BPR processes, respectively.
Figure 10B:
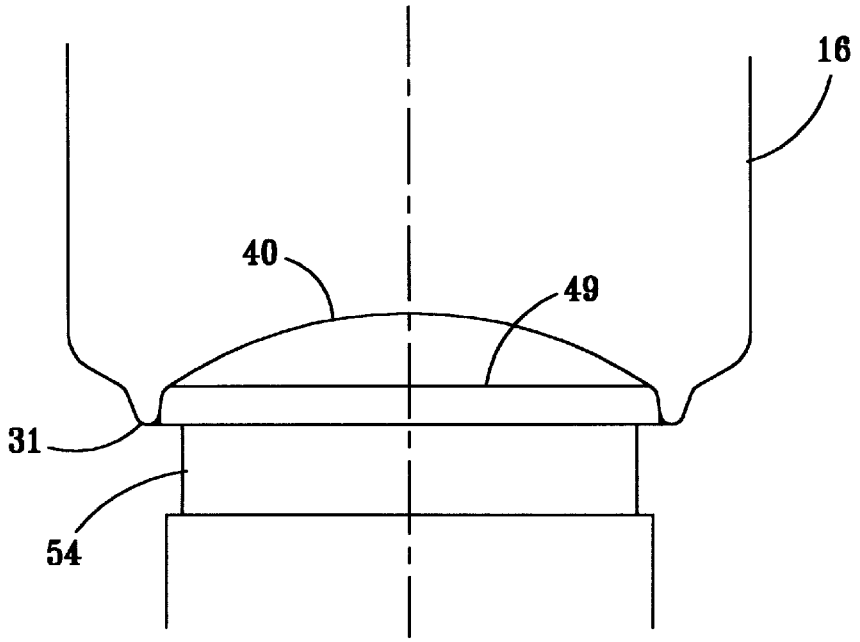
FIG. 10b (PRIOR ART)

Previously, as best seen in FIG. 8*b*, the configuration and dimensions of the dome forming region of the dome plug 48 were nearly identical to the dome forming region of the punch nose 46. The only difference between the two was that the diameter of the dome plug 48 was less than the diameter of the rim forming region of the punch nose 46 by a distance equal to twice the thickness of the metal of the can bottom plus 0.010" clearance. Thus, the dome plug diameter "C" for a particular can size undergoing manufacture was the same as the inner diameter of the dome 40. This configuration was selected on the basis of developmental efforts which suggested that maximum resistance to pressure loads would be provided by a vertical inner leg 32. To provide a vertical inner leg 32, the distance between the dome plug 48 and the punch nose 46 was minimized to be equal to that of the thickness of the metal of the can bottom 18 plus 0.010 clearance. As best seen in FIG. 10*b*, the BPR plug or chuck 54 had the same diameter as the dome plug 48; however, its configuration differed in that it had a flat or horizontal upper surface 49 rather than a domed shaped one. As best seen in FIGS. 8*a* and 10*a* it has now been found that reducing the diameter of the dome plug 48, and making the corresponding reduction in the diameter of the BPR chuck 54, by approximately 0.02" such that the dome plug 48 no longer has a configuration identical to that of the region circumscribed by the arcuate rim in the final preform, provides additional resistance to pressure loads, thereby allowing the lightweighting of the can bottom by approximately 0.0002–0.0003".

Figure 5:
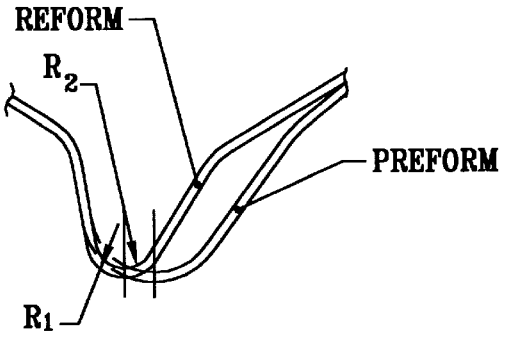
FIG. 5 is a cross-sectional view of the end wall rim illustrating the factors significant in controlling the pressure resistance of the can.

Referring now to FIG. 5, there is shown the can bottom profile of the preform and the reform. Both $R_1$ and $R_2$ are known to be significant factors controlling the DRP strength of the can such that the smaller $R_1$ and $R_2$, the greater the DRP.

Figure 6:
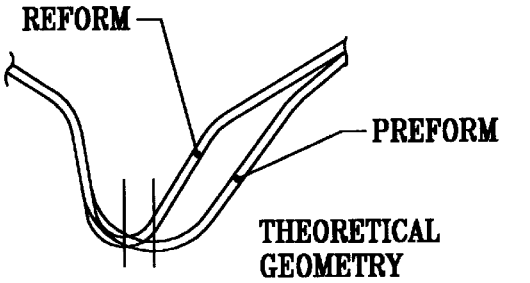
FIG. 6 (PRIOR ART)
FIG. 6 is a cross-sectional view of the end wall rim showing the theoretical geometry resulting from the existing base profile reform process.
Figure 7:
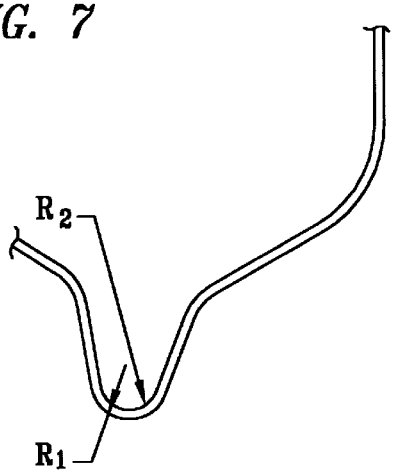
FIG. 7 is a representation of a photomicrograph showing a cross-sectional view of the end wall rim and the actual geometry resulting from the existing base profile reform process.

Of these two factors it is also known that $R_1$, is the most significant. The BPR process was invented to reduce the size of both $R_1$, and $R_2$. Theoretical profiles assumed an equal reduction of $R_1$, and $R_2$. (FIG. 6) However, these values were not attained in practice. While the existing BPR process efficiently reduced the size of $R_2$, it did not significantly alter the geometry of $R_1$. This resulted in a bottom can profile wherein the radius of curvature of $R_1$ is greater than the radius of curvature of $R_2$ (FIG. 7). According to the present invention, both $R_1$, and $R_2$ can be reduced to an equal extent by modifying both the preform geometry and tooling, and the tooling geometry in the BPR machine.

The preform geometry was modified by reducing diameter "C", (FIG. 8*a*) the dome plug diameter, by 0.02" as compared to the existing process (FIG. 8*b*) to provide a slight outward bend on the inner leg 32 of the preform geometry (FIG. 9).

The final reform geometry was modified by making a corresponding 0.02" reduction of diameter "C" on the BPR chuck 54 or plug (FIGS 10*a* and 10*b*). This modification permits an efficient reforming—smaller $R_1$, and $R_2$—in the BPR process. Additionally, it results in an inner leg 32 having a generally vertical lower portion 32*b* and an upper portion 32*a* having a back angle which provides a secondary strengthening feature to the bottom profile geometry (FIG. 11).

EXAMPLES

Example 1

Under the existing process, for the manufacture of a can size of 204×211×413 (2 4/16" neck diameter×2 11/16" can body diameter×4 13/16" can body height), "C", the diameter of the dome plug and BPR chuck, was 1.863 inches. Utilizing the present invention, the same size can was manufactured using a diameter for the dome plug and BPR chuck of 1.843 inches.

Referring to FIG. 2, the final can product had an arcuate rim 30 with a radius, measured from vertical axis X, of about 0.955" and a convex arcuate segment 22, lower concave arcuate segment 26, outer radius $R_1$, inner radius $R_2$, and second concave arcuate segment 34 with a radius of curvature of about 0.150", 0.090", 0.025", 0.025", and 0.050", respectively.

Example 2

Under the existing process, for the manufacture of a can size of 202×211×413 (2 2/16" neck diameter×2 11/16" can body diameter×4 13/16" can body height), "C", the diameter of the dome plug and BPR chuck, was 1.863 inches. Utilizing the present invention, the same size can was manufactured using a diameter for the dome plug and BPR chuck of 1.843 inches.

Referring to FIG. 2, the final can product had an arcuate rim 30 with a radius, measured from vertical axis X, of about 0.955" and a convex arcuate segment 22, lower concave arcuate segment 26, outer radius $R_1$, inner radius $R_2$, and second concave arcuate segment 34 with a radius of curvature of about 0.150", 0.090, 0.025", 0.025", and 0.050", respectively.

Example 3

Under the existing process, for the manufacture of a can size of 204×211×603 (2 4/16" neck diameter×2 11/16" can body diameter×6 3/16" can body height), "C", the diameter of the dome plug and BPR chuck, was 1.863 inches. Utilizing the present invention, the same size can was manufactured using a diameter for the dome plug and BPR chuck of 1.843.

Referring to FIG. 2, the final can product had an arcuate rim 30 with a radius, measured from vertical axis X, of about 0.955" and a convex arcuate segment 22, lower concave arcuate segment 26, outer radius $R_1$, inner radius $R_2$, and second concave arcuate segment 34 with a radius of curvature of about 0.150", 0.090, 0.025", 0.025", and 0.050", respectively.

We claim:

1. In a process utilized to manufacture a can body with a domed end wall circumscribed by an annular rim wherein the can body is initially formed with a flat end wall in a drawing and ironing process and the domed end wall is subsequently formed by, first, forming a preform by driving in a punching operation the flat end wall of the can body against a dome plug with a punch comprising a punch sleeve and a punch nose while simultaneously exerting clamping pressure against the exterior of the can with an outer retainer or forming die to form a preform bottom having a wall thickness of Y and a dome with an inside diameter X circumscribed by an annular rim, and second, of forming a reform by driving a rotatable exterior reforming roll against the outer leg of the annular rim of the domed preform bottom which is spinning and being supported by an interior BPR chuck having the same diameter as the dome plug, the improvement comprising forming the preform bottom using a dome plug with a diameter which is less than (X−((2×Y)+0.01 inches)) and forming the reform using a BPR chuck with a diameter which is less than (X−((2×Y)+0.01 inches)).

2. A process in accordance with claim 1 wherein the dome plug has a diameter which is at least about ((2×Y)+0.02 inches) less than X and the BPR chuck has a diameter which is at least about ((2×Y)+0.02 inches) less than X.

3. A process in accordance with claim 2 wherein the dome plug has a diameter which is about ((2×Y)+0.03 inches) less than X and the BPR chuck has a diameter which is about ((2×Y)+0.03 inches) less than X.

4. A process for manufacturing a can body with an improved domed end wall configuration comprising a convex arcuate segment, the tapered intermediate portion, a first concave arcuate segment, a tapered outer leg, an arcuate rim comprising an outer radius and an inner radius, an inner leg having a back-angled portion, a second concave arcuate segment, and a domed central section having an outer and inner region, wherein said arcuate segments interconnect the regions located immediately adjacent on either side, comprising:

(a) blanking a disk from sheet metal stock;

(b) drawing the disk into a cup having a flat end wall and cylindrical sidewall;

(c) driving the cup through a succession of dies to form a cylindrical can body with a flat end wall;

(d) forming a preform having a domed end wall circumscribed by an annular rim by driving, in a punching operation, the flat end wall of the can body against an externally positioned dome plug with an internally positioned punch comprising a punch sleeve and a punch nose the diameter of the dome plug being selected such that the lateral clearance on each side between the dome plug and the punch nose is greater than the thickness Y of the metal of the can bottom, while simultaneously exerting clamping pressure against the exterior of the annular rim with a forming die; and (e) forming a reform having an inner leg with a back-angled portion by driving, in a spinning operation, a rotatable exterior reforming roller against the outside of the annular rim of the domed preform bottom which is spinning and being supported by a BPR chuck having a diameter equal to that of the dome plug used in forming the preform.

5. A process in accordance with claim 4 wherein the diameter of the dome plug is selected to provide a clearance on each side of at least about (Y+0.01 inches) between the dome plug and the punch nose.

6. A process in accordance with claim 5 wherein the diameter of the dome plug is selected to provide a clearance of about (Y+0.015 inches) on each side between the dome plug and the punch nose.

7. A method for forming a bottom of a can body such that the bottom has a domed center section circumscribed with an annular rim and an inner leg of the annular rim has a back-angled portion providing improved strength, said method comprising the steps of:

using a punch assembly positioned within the can body to drive the can body in a punching operation against an externally positioned outer retainer having an annular passage formed therethrough, until the can body is clamped between the punch assembly and the outer retainer;

driving, in a punching operation, a dome plug having a domed center configuration and a diameter C, the value of C being less than (X−((2×Y)+0.01 inches)), where X is the inner diameter of the rim forming region of the punch nose and Y is the thickness of the can bottom, against the punch assembly, the outer retainer, and the can body clamped therebetween and partially through the annular passage to form a preform having a bottom with a domed center section circumscribed by an annular rim;

driving, in a spinning operation, a rotatable exterior reforming roller against the outside of the arcuate rim of the preform bottom which is spinning and being supported by a BPR chuck which is positioned within the center section of the preform, which has a diameter C, and which does not have a back-angled profile, to form a back-angled portion on the inner leg of the arcuate rim.

8. A method in accordance with claim 7, wherein the value of C is less than about (X−((2×Y)+0.02 inches)).

9. A method in accordance with claim 8, wherein the value of C is about (X−((2×Y)+0.03 inches)).

* * * * *